US006698115B2

(12) United States Patent
Theurer et al.

(10) Patent No.: US 6,698,115 B2
(45) Date of Patent: Mar. 2, 2004

(54) CLEARING CHAIN FOR EXCAVATING BULK MATERIAL

(75) Inventors: Josef Theurer, Vienna (AT); Herbert Wörgötter, Gallneukirchen (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 69 days.

(21) Appl. No.: 10/103,083

(22) Filed: Mar. 21, 2002

(65) Prior Publication Data

US 2002/0139016 A1 Oct. 3, 2002

(30) Foreign Application Priority Data

Apr. 2, 2001 (AT) ..... 243/01 U

(51) Int. Cl.[7] ..... E02F 5/02
(52) U.S. Cl. ..... 37/465; 37/107
(58) Field of Search ..... 37/465, 462, 463, 37/464, 454, 460, 104, 105, 106, 107; 299/84.1

(56) References Cited

U.S. PATENT DOCUMENTS 2,036,327 A * 4/1936 Fulke ..... 299/84.1
2,048,702 A * 7/1936 Joy ..... 299/84.1
2,404,540 A 7/1946 Simmons
2,661,940 A * 12/1953 Rollins ..... 299/84.1
2,880,964 A * 4/1959 Straitiff ..... 175/89
2,946,142 A * 7/1960 Swanson ..... 37/347
2,965,365 A * 12/1960 Krekeler ..... 299/109
3,913,979 A * 10/1975 Strauss et al. ..... 299/84.1
4,404,761 A * 9/1983 Paulin et al. ..... 37/465
4,614,238 A 9/1986 Theurer et al.
5,090,483 A * 2/1992 Theurer et al. ..... 171/16
5,271,166 A * 12/1993 Theurer ..... 37/104
5,694,708 A * 12/1997 Theurer et al. ..... 37/104
5,907,914 A * 6/1999 Theurer ..... 37/105
5,926,981 A * 7/1999 Theurer ..... 37/104
6,014,826 A * 1/2000 Walgren et al. ..... 37/456

FOREIGN PATENT DOCUMENTS

EP 378025 A * 12/1989 ..... E01H/8/00

* cited by examiner

*Primary Examiner*—Robert E. Pezzuto
*Assistant Examiner*—Alexandra K. Pechold
(74) *Attorney, Agent, or Firm*—Henry M. Feiereisen

(57) ABSTRACT

A clearing chain is mounted on a mobile track maintenance machine for excavating ballast material from a track bed. The chain is composed of shovel-type clearing members for gathering the ballast and intermediate chain elements positioned between the adjacent clearing members and connected thereto by means of chain joints, thus forming an endless chain. Each intermediate chain element comprises two chain joints spaced from one another in the longitudinal direction of the clearing chain. The chain joints are designed for receiving a hinge pin articulatedly mounted in the joint and releasably fastened to the clearing member.

5 Claims, 2 Drawing Sheets

CLEARING CHAIN FOR EXCAVATING BULK MATERIAL

CROSS-REFERENCES TO RELATED APPLICATIONS

This application claims the priority of Austrian utility model document GM 24312001, filed Apr. 2, 2001, pursuant to 35 U.S.C. 119(a)–(d), the subject matter of which is incorporated herein by reference.

BACKGROUND OF THE INVENTION

The present invention relates to a clearing chain for excavating bulk material from a ballast bed supporting a track and for conveying the excavated bulk material, and more particularly to a clearing chain of a type including a plurality of shovel-type clearing members sequentially arranged in the direction of elongation of the chain for gathering and moving along the bulk material, the chain being mounted on a frame of a mobile track working machine.

U.S. Pat. No. 4,614,238 discloses an articulatedly constructed clearing chain of this type which is composed of a multitude of similarly formed chain elements connected to one another by means of respective chain joints. Every third chain element is connected by means of a screwed connection to a clearing element designed for excavating or collecting bulk material. The chain joints are shaped as universally movable cross joints. Such a flexible clearing chain can be guided in a three-dimensional path; however, the structural design required for this purpose is relatively complicated.

It would therefore be desirable and advantageous to provide an improved clearing chain which obviates prior art shortcomings and which, while retaining the feature of universally movable joints, can be manufactured in a simple manner.

SUMMARY OF THE INVENTION

According to one aspect of the present invention, a clearing chain includes intermediate chain elements positioned in each case between two adjacent clearing members for forming an endless chain, each intermediate chain element including two chain joints spaced from one another in the direction of elongation of the chain, each chain joint having a joint axis; and hinge pins for hingedly connecting the clearing members and intermediate chain elements to one another at each chain joint, the hinge pins being releasably fastened to the clearing member and articulatedly mounted in the chain joint.

This particular design of the clearing chain, being composed of clearing members and intermediate chain parts alternatingly following one another in the direction of longitudinal extension of the chain, already results in a simplification of the structural complexity of the chain. An additional advantage is due to the circumstance that the individual clearing members have no moving or articulated parts and therefore can be manufactured in a simple manner, producing a sturdy component which is particularly suited for robust use under diverse conditions.

Preferably, the chain joint includes a joint bearing designed as a spherical bearing, including a knuckle eye and a ball race which is universally movably mounted in the knuckle eye and surrounds the hinge pin extending in the direction of the joint axis. This feature provides the required degree of flexibility to guide the chain in a three-dimensional manner while ensuring simplicity and robustness of design.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
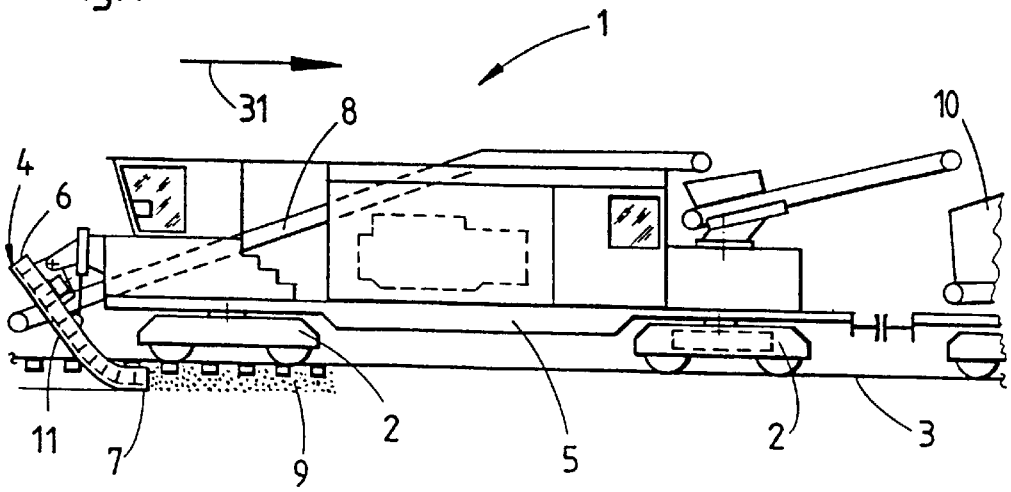
FIG. 1 is a simplified side view of a track working machine according to the present invention having a clearing chain for excavating ballast situated underneath a track.

Throughout all the Figures, same or corresponding elements are generally indicated by same reference numerals.

Turning now to the drawing, and in particular to FIG. 1, there is shown a simplified side view of a track working machine 1 which has a machine frame 5 supported on undercarriages 2 for mobility on a track 3. The track is comprised of rails fastened to ties resting on ballast 9 forming a track bed. The operating direction of the machine is indicated by arrow 31. At the rear end of the machine 1, with regard to the operating direction, a clearing chain 4 for excavating bulk material is mounted for vertical adjustment on the machine frame 5. In operation, the endless clearing chain is guided around the track 3, with an excavating section 7 of the chain passing underneath the track and being positioned in the ballast bed. In its upper region, the clearing chain 4 has an ejection end 6 positioned above a receiving end of a conveyor belt 8 for transporting excavated ballast 9 to a bulk material loading wagon 10 coupled to the machine 1. Between the excavating section 7 and the ejection end 6, the clearing chain 4 is guided in a curved guide track 11. This ensures that ballast 9 can be gathered underneath the track 3 and transported upwards to the conveyor belt 8 in an optimal manner even under the most confined spatial conditions.

Figure 2:
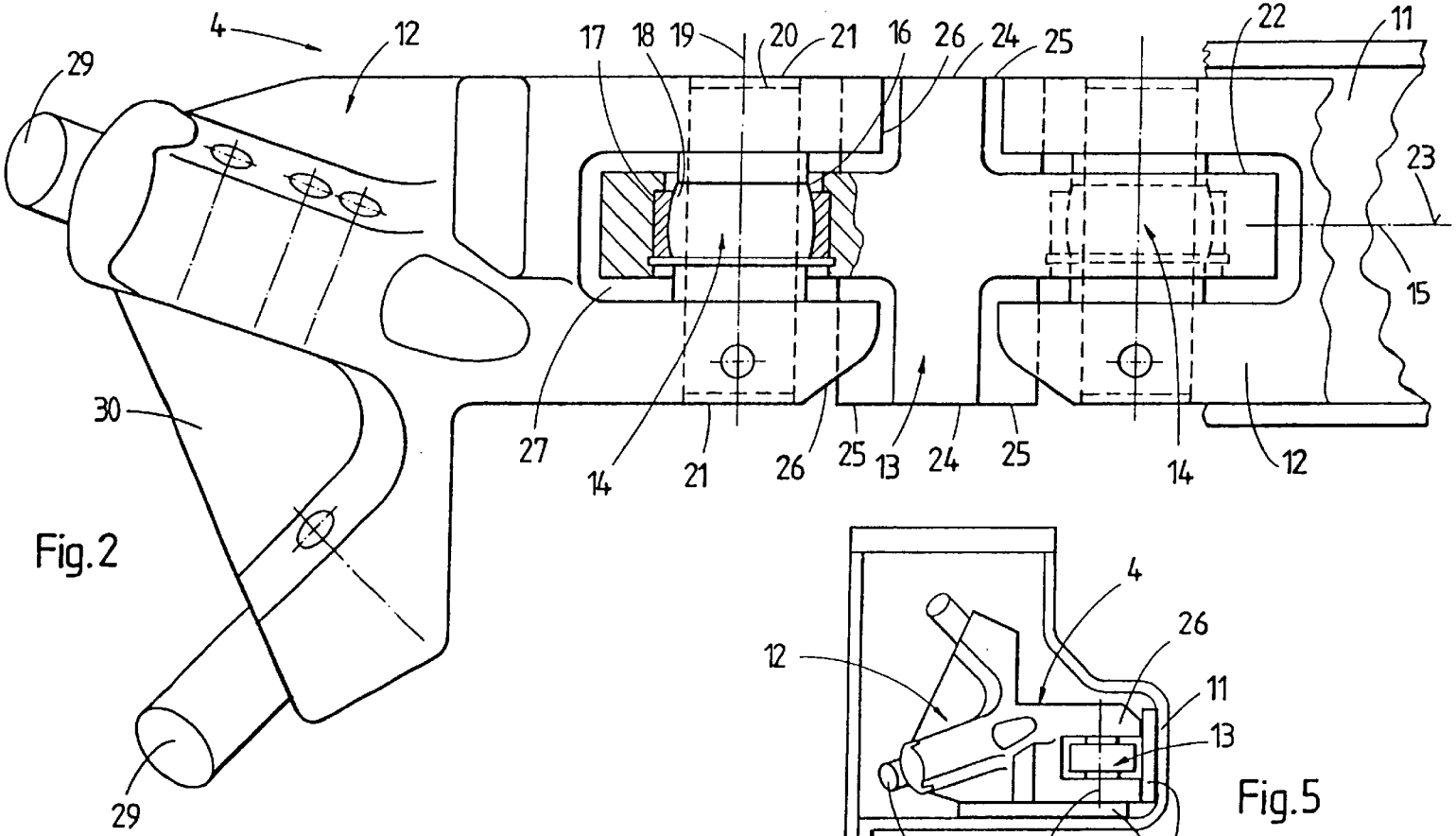
FIG. 2 is a fragmentary, partially sectional view of the chain.

As shown in detail in FIG. 2, the clearing chain 4 is composed of clearing members 12 and intermediate chain elements 13, arranged alternatingly in the direction of longitudinal extension, or longitudinal direction 15, of the chain 4 and connected to one another in each case by means of a respective chain joint 14 having a joint axis 19. Each clearing member 12 is equipped with finger-shaped engaging elements 29 and a shovel part 30 which cooperate to gather and move along the ballast material to be excavated.

Each intermediate chain element 13 comprises a main portion 22 which is positioned in a plane 23 extending perpendicularly to the joint axis 19. The main portion 22 includes two chain joints 14 spaced from one another in the longitudinal direction 15 of the clearing chain 4. Each chain joint 14 is designed as a joint bearing 16 which is rotatable in all directions. To that end, the joint bearing 16 is shaped as a spherical bearing having a knuckle eye 17 in which a ball race 18 is freely movably mounted. The ball race 18 surrounds a hinge pin 20 the pin axis of which coincides with the joint axis 19.

In the region of the joint bearing 16, each clearing member 12 includes two parallel joint plates 26 spaced from one another in the direction of the joint axis 19, thus forming a recess 27 in which the joint bearing 16 is received. Each joint plate 26 has a bore 21 in which the hinge pin 20 of the associated bearing 16 is anchored for connecting the clearing member 12 and the intermediate chain element 13 to one another.

Figure 3:
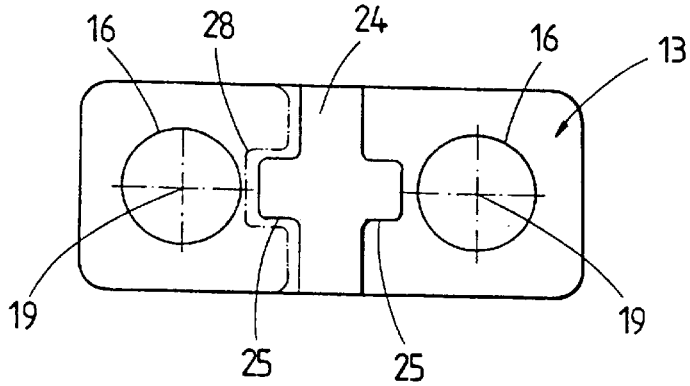
FIG. 3 is a detailed top view of a chain element.
Figure 4:
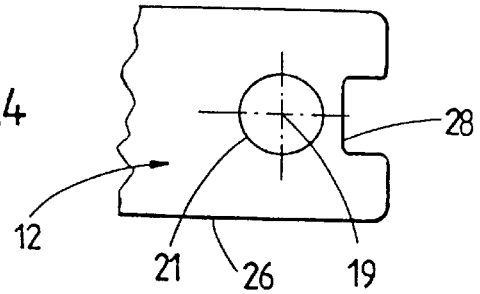
FIG. 4 is a detailed top view of a clearing member.

As indicated also in FIG. 3, the intermediate chain element 13 further includes stabilizing webs 24, positioned on both the upper and the lower side of the main portion 22 and situated centrally between the two joint bearings 16. The stabilizing webs 24 extend perpendicularly to the longitudinal direction 15 of the clearing chain 4 and comprise stabilizing noses 25 extending out from the stabilizing web 24 at both sides thereof in the longitudinal direction 15. As shown further in FIG. 4, each joint plate 26 of the clearing member 12 is provided with an indentation 28 in which the stabilizing nose 25 of the adjoining intermediate chain element 13 is received.

Figure 5:
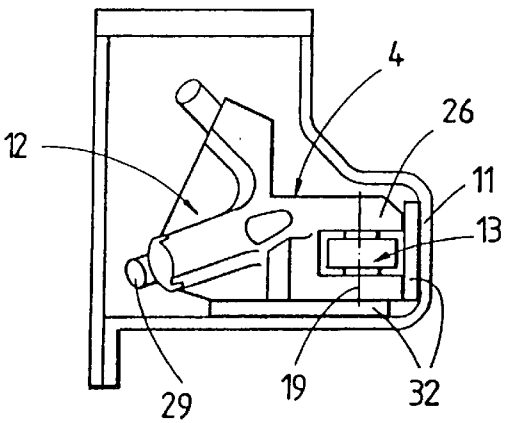
FIG. 5 is a cross-sectional view of the clearing chain.

FIG. 5 shows a section through the clearing chain 4 positioned inside the guide track 11. Sliding plates 32 are arranged inside the guide track 11 at the bottom and inner side wall thereof, having a slippery surface to facilitate the movement of the clearing chain 4, or the clearing members 12 and intermediate chain elements 13, making contact with the guide track 11.

While the invention has been illustrated and described as embodied in a clearing chain for excavating bulk material, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

1. A clearing chain for excavating bulk material from a ballast bed supporting a track and for conveying the excavated bulk material, the chain being mounted on a frame of a mobile track working machine and comprising a) a plurality of shovel-type clearing members sequentially arranged in direction of elongation of the clearing chain for gathering and removing the bulk material;

b) intermediate chain elements positioned between two adjacent clearing members for forming an endless chain, each said intermediate chain element including two chain joints spaced from one another in the direction of elongation of the clearing chain, each chain joint having a joint axis; and c) hinge pins for hingedly connecting the clearing members and intermediate chain elements to one another at each chain joint, each said hinge pin being releasably fastened to the clearing member and articulatedly mounted in the chain joint, wherein each said chain joint is a pivot joint bearing designed as a spherical bearing, and includes a knuckle eye and a ball race which is universally movably mounted in the knuckle eye and surrounds the hinge pin extending in the direction of the joint axis.

2. The clearing chain of claim 1, wherein the intermediate chain element includes a main portion, which is positioned in a plane extending perpendicularly to the joint axis and connected to the two joint bearings, and two stabilizing noses, which are positioned centrally between the two joint bearings and arranged on an upper and lower side of the main portion with regard to the direction of the joint axis.

3. The clearing chain of claim 2, wherein each clearing member includes two joint plates arranged in the region of a said joint bearing and spaced from one another in the direction of the joint axis, thereby defining a recess, each joint plate having a bore for receiving a said hinge pin.

4. The clearing chain of claim 3, wherein each joint plate includes an indentation for receiving the stabilizing nose of the adjoining intermediate chain element.

5. The clearing chain of claim 2, wherein each intermediate chain element includes a stabilizing web arranged centrally with regard to the stabilizing noses and extending perpendicularly to the direction of elongation of the chain.

* * * * *